343-872

3/22/83 OR 4,377,812 SR

United States Patent [19]

Göbel et al.

[11] 4,377,812

[45] Mar. 22, 1983

[54] SEGMENTED PROTECTIVE SHELL FOR TOWER MOUNTED ANTENNAS WITH VIBRATION DAMPING

[75] Inventors: Arthur Göbel; Rudolf Göbel; Hartmut Patschke, all of Ludwigshafen, Fed. Rep. of Germany

[73] Assignee: G + H Montage GmbH, Ludwigshafen, Fed. Rep. of Germany

[21] Appl. No.: 218,831

[22] Filed: Dec. 22, 1980

[30] Foreign Application Priority Data

Dec. 21, 1979 [DE] Fed. Rep. of Germany ..... 2951590
Jun. 28, 1980 [DE] Fed. Rep. of Germany ..... 3024505

[51] Int. Cl.[3] ..... H01Q 1/42
[52] U.S. Cl. ..... 343/872
[58] Field of Search ..... 343/872, 873, 874, 875

[56] References Cited

U.S. PATENT DOCUMENTS 3,303,506 2/1967 Diebold ..... 343/872

FOREIGN PATENT DOCUMENTS 1125013 8/1960 Fed. Rep. of Germany ..... 343/872
2308297 8/1974 Fed. Rep. of Germany ..... 343/872

*Primary Examiner*—Eli Lieberman
*Attorney, Agent, or Firm*—Cushman, Darby & Cushman

[57] ABSTRACT

A tower or cupola-like covering for the protection of radio or television antennae against the weather is made in the form of a sectional casing with each section of the casing being attached only along its bottom or top edge to a supporting structure, with expansion joints between such edges that transmit no supporting forces. The construction eliminates compression or tension forces in the covering which might damage the same.

17 Claims, 5 Drawing Figures

SEGMENTED PROTECTIVE SHELL FOR TOWER MOUNTED ANTENNAS WITH VIBRATION DAMPING

BACKGROUND AND SUMMARY OF THE INVENTION

The invention relates to the protection of radio engineering installations, especially antennae, against the influences of the weather, in the form of a tower or cupola-shaped casing supported by a carrying mechanism and made of hard plastic, especially a plastic having a polyurethane base.

Such a casing is known from German Pat. No. 12 73 023. In this known casing, segments are pre-manufactured from polyurethane hard foam in easily transportable sizes and are connected at the erection site by adhesion. For example, individual casing-shaped sections, each consisting of, for example, 12 segments, are made which, placed on top of one another, may form a tower-like casing for, for example, antennae. In case of a covering of long antenna masts, a lateral positional security of the casing, which is self-supporting in the manner described, is accomplished by carrying mechanisms disposed on the antenna mast, especially in the area of the platforms disposed one above the other of customary radio antenna masts. Similarly, an essentially ball or ball-calotte-shaped covering or casing for rotatably movable antennae may be developed, say for radar monitoring, which may be placed on a construction at the building site.

Since antennae, especially radio antennae, are erected on exposed locations, such as hills, mountains, buildings, such as TV towers, etc., as is well known, in order to obtain as far a reach as possible, said antenna masts and their covering are regularly exposed to considerable lateral thrusts due to wind. These lateral thrusts due to wind, when flowing around the casing, create corresponding pressure and suction loads which try to deform the casing. Furthermore, the lateral thrusts due to wind lead often to considerable vibrational deflections, especially of long antenna masts, and because of vibration stimulation as a result of shedding of vortices at the periphery of the casing and of the building carrying the masts, lead to natural vibrations, especially of the antenna masts, the vibrational deflections of which, in turn, are introduced into the casing. As a result of that, the wall of a casing consisting of hard plastic is subject to considerable rapidly changing tension and buckling loads, which lead to a considerable and disturbing development of noise. Finally, the changing of the permanent loads of the casing will lead to fatigue of the material and thus to breakdowns.

Besides loads on the casing or covering caused by wind, which occur also in shorter but larger cupolas, say, for example, radar antennae, there also occur loads due to heat expansion. Especially in conjunction with such additional loads, the load caused by wind may lead, especially in the area of the places of adhesion between individual segments, to cracks through which moisture may penetrate.

As compared to this, this invention provides a covering, the material of which is exposed to considerably lower loads so that service life is increased and noise development may possibly be reduced.

To accomplish this, the casing or—in case of a multistory tower—each section is attached only at its top or bottom rigidly to a supporting mechanism. Thus, an introduction of tensions into the casing, by relative movement between it and carrying mechanisms or other mutual supports, is avoided. Especially in the case of long antenna masts, a construction which permits free vertical movement, preferably of the upper edge of a section, makes lateral vibration deflections of the antenna mast possible without introducing tension or buckling stresses into the material of the casing. As a result, the covering even in stormy weather, produces no noise in a disturbing volume. Further, greatly increased service life of the covering results because of the considerable decrease of stress in the material. It is also possible to make a division of the casing or of the sections at a distance from the supports or the supporting mechanisms, and to place an expansion joint between the divisions of the casing. Depending on the situation of the individual case, a vertical and/or horizontal expansion joint may be selected in order to avoid a build-up of stress in case of relative movement of adjoining edges of the casing. It is essential that the expansion joint does not transfer any supporting force so that it is without tension and consequently may always accommodate the relative movement without thereby causing a condition essential to build-up of tension in the casing.

Further details, characteristics and advantages of the invention will be understood from the subsequent description of embodiments based on the drawings.

DETAILED DESCRIPTION OF THE DRAWINGS

Figure 1:
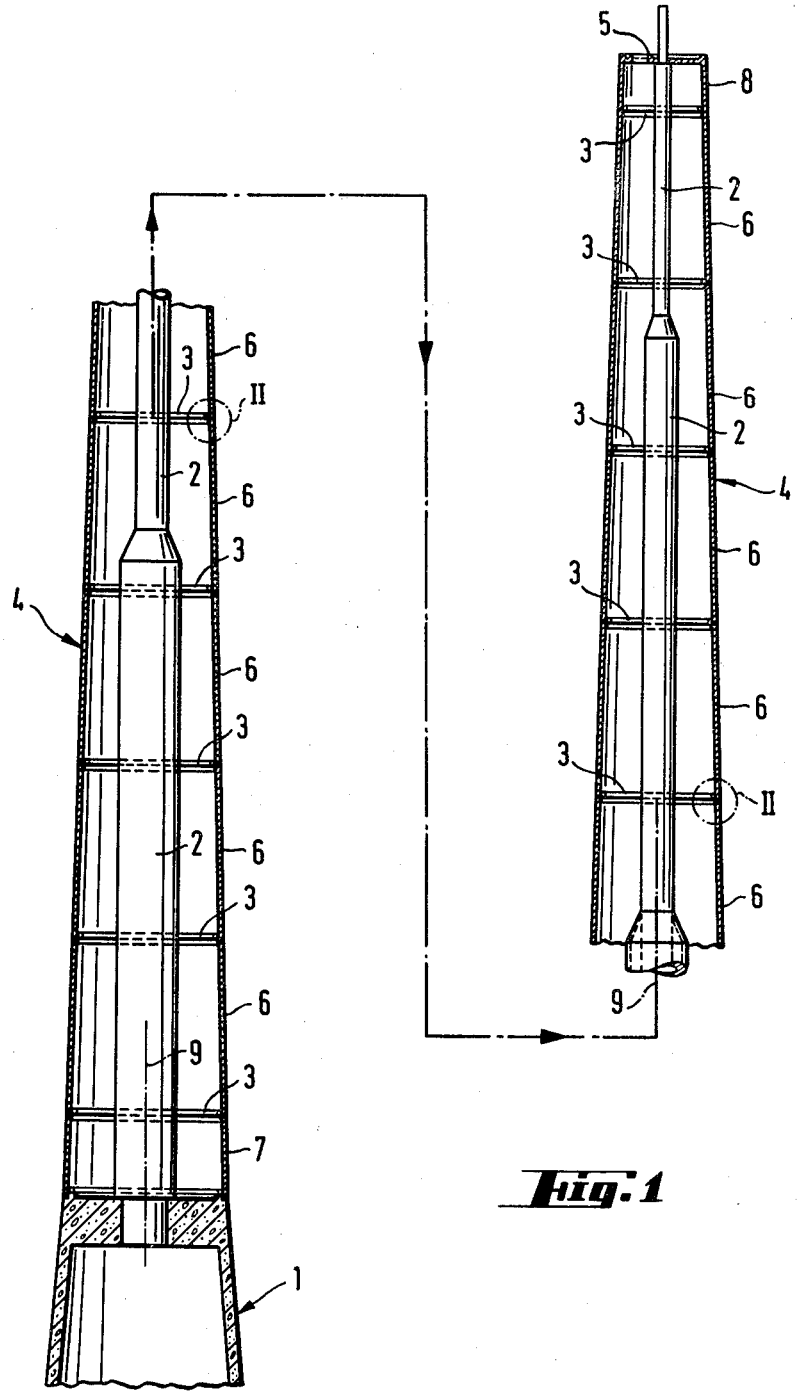
FIG. 1 shows schematically simplified a general representation of an antenna mast at the top of a TV tower provided with a casing according to the invention.

In FIG. 1, numeral 1 designates a concrete top of a TV tower on which an antenna mast 2 has been placed. On its periphery the mast 2 carries in a manner known per se a multiplicity of antennas not shown in detail. In superposed planes, nine carrying mechanisms 3, such as platforms, are attached, for example, so the periphery of the antenna mast 2, the diameter of which becomes gradually smaller in an upward direction. The platforms 3 serve as carriers for a casing, designated generally by 4, which provides a covering for the antenna mast 2. If the distance between the platforms or carrying mechanisms 3, for example, amount to about 4.8 m, between the concrete top 1 of the TV tower and an upper roof 5 of the casing 4 there may be a difference in height of more than 40 m. At the same time, the diameter of the casing 4 may be 4.6 m at the lower end and reduce to about 2.5 m in the area of the roof 5, and the diameter at the bottom end of the antenna mast 2 may be about 1.7 m. As is apparent without difficulty from these dimensions given by way of example, especially in an exposed position, say at the top of the TV tower in the case of stress by wind, considerable vibrational deflections of the antenna mast 2 occur as well as, in the event of resonance with vortex redemption frequencies, clear natural vibrations of the longitudinally extended antenna mast 2. In the event of a rigid attachment of the casing 4 to the platform 3, such vibrations are transmitted as tensional and buckling stresses in the peripheral wall of the casing which cause a development of noise and lead to premature fatigue of the material of the casing. Similar phenomena also occur in cupola-shaped coverings for radar antennas, etc., since a cupola has considerably larger dimensions and is made essentially self-supporting.

The casing 4 consists of a multiplicity of superposed sections 6, in the case of above examples of equal height between the individual carrying mechanisms 3, as well as a shorter section 7 on the bottom and a shorter section 8 on the top. Each section 6, 7 or 8 is composed in a manner known per se from a multiplicity of, for example, 12 individual peripheral segments, in a manner not shown in detail, whereby individual segments abut on expansion joints and are glued together at the building site. The lowest section 7 is seated on the correspondingly developed concrete top 1, whereas the sections 6 and 8 above it are attached, in a manner explained in more detail below, with their lower ends supported on the corresponding carrying mechanisms 3 while the upper ends of the sections 6 and 7 are mounted for vertical movement.

Figure 2:
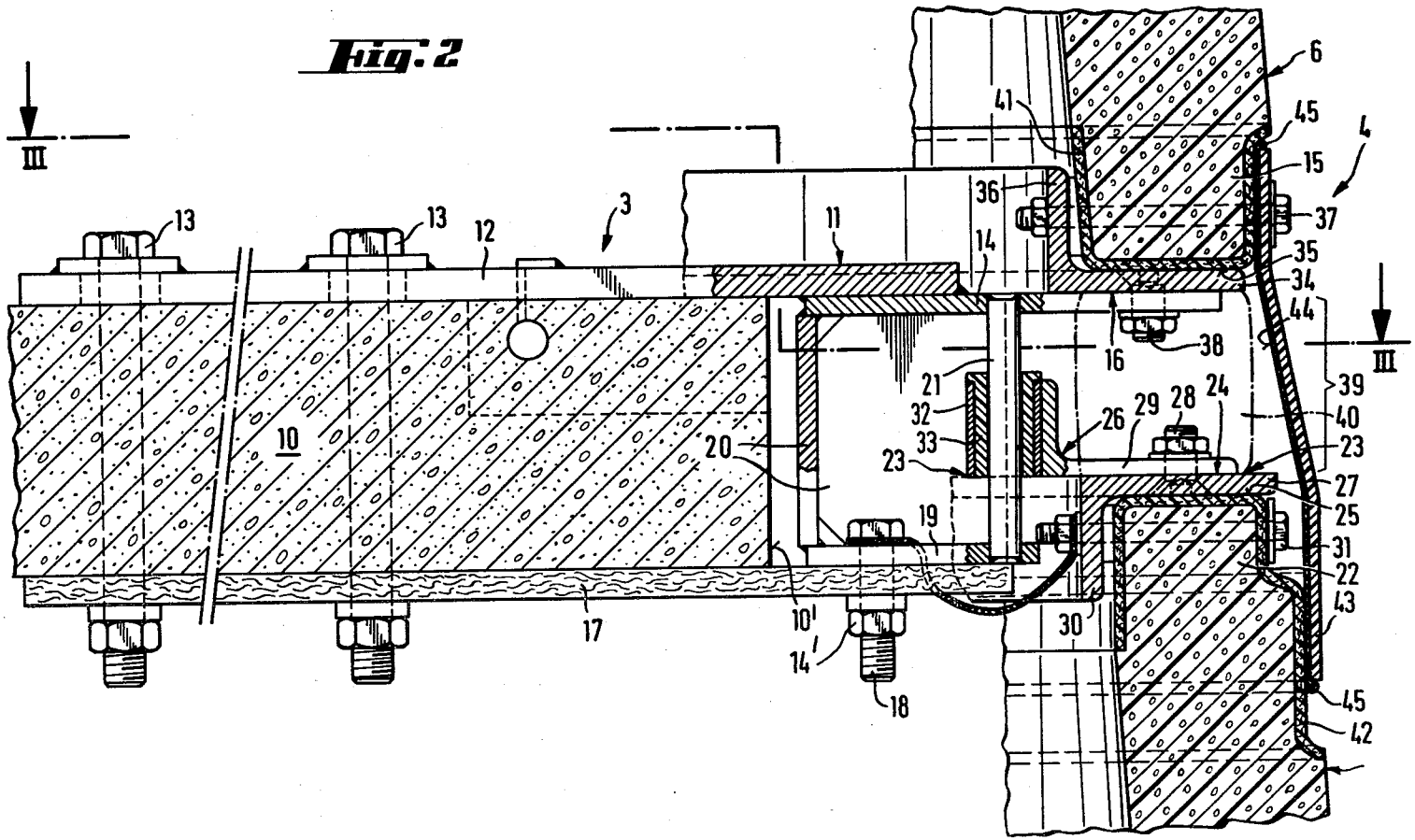
FIG. 2 shows details according to circle II in FIG. 1 in an enlarged presentation as well as in section.
Figure 3:
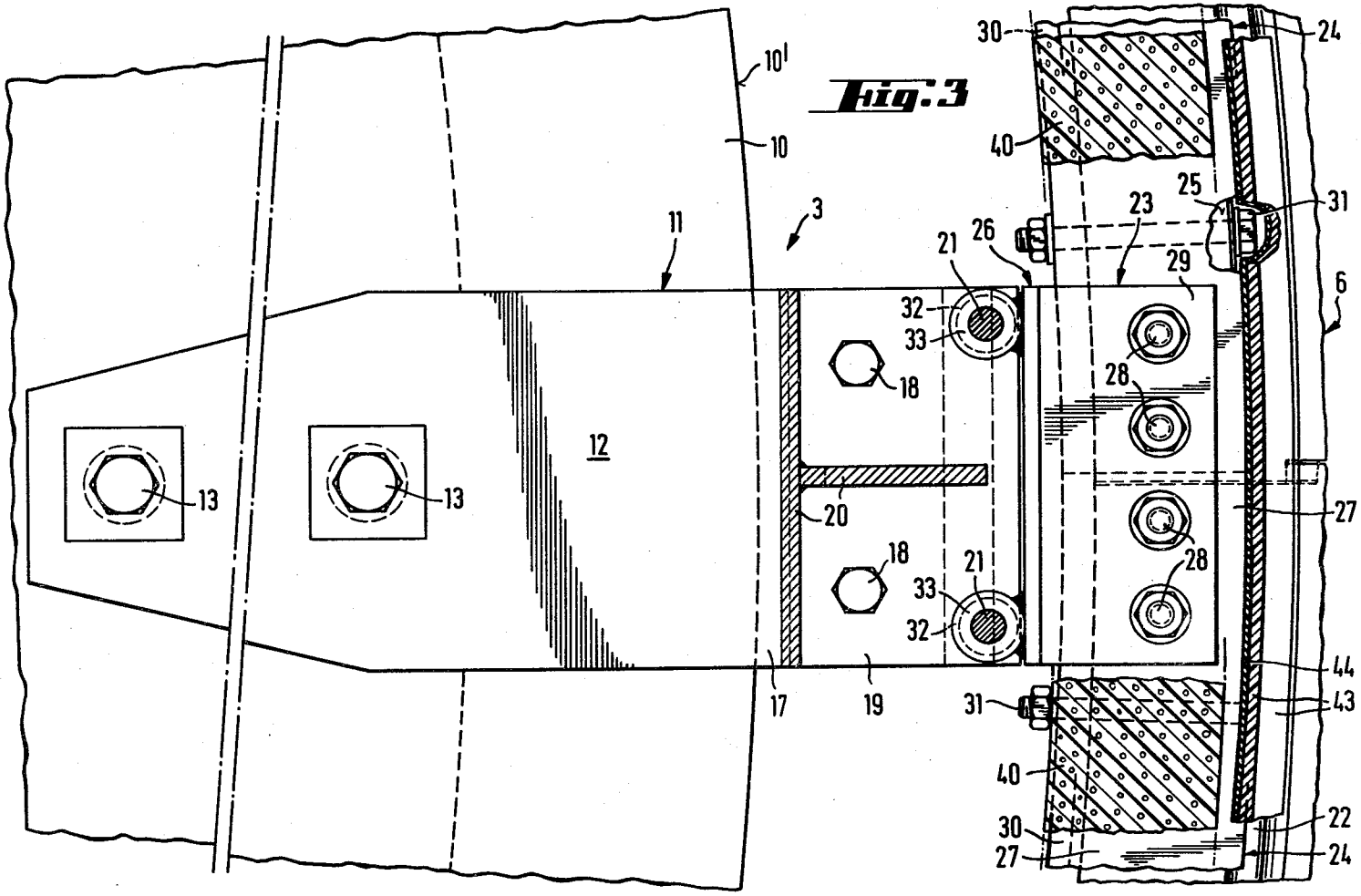
FIG. 3 is a sectional view on line III—III in FIG. 2.

As is apparent from FIGS. 2 and 3, each carrying mechanism 3 consists of a platform or a cantilever 10 of any suitable type of construction, e.g. steel or possibly concrete, as shown, which includes a supporting mechanism 11 for attaching the casing 4. The supporting mechanism 11 consists of a multiplicity of steel fishplates 12 which, in the manner apparent from FIGS. 2 and 3, are attached by screw bolts 13 on top of the cantilever 10 so that they project radially from the peripheral edge 10' of the platform 10. To the projecting portion of each steel fishplate 12, a steel carrying plate 14 is welded to form a support for the lower edge 15 of the upper section 6. For this, an angular rail 16, following the shape of the lower edge 15 of the upper section 6, is secured on top of the carrying plate 14 in the radial area of the lower edge 15 of the upper section 6.

On the underside of the platform 10 an additional fishplate 17 is secured by screw bolts 13. The fishplate 17 may consist of glass fiber reinforced plastic such as epoxy resin, and likewise projects radially beyond the peripheral edge 10' of the platform 10. A bottom plate 19 is attached by screw bolts 18 and nut 14' on top of the projecting portion of the fishplate 17. Between the upper supporting plate 14 and the lower bottom plate 19 there is a T-shaped stiffening construction 20, best shown in FIG. 3, which is welded to the carrying plate 14 and the bottom plate 19 so that a box-shaped housing results. In the area of the radially outer, open end of this housing, between the upper carrying plate 14 and the lower bottom plate 19, two guide bolts 21 are disposed vertically and in parallel to one another and are secured, for example, by welding.

The upper edge 22 of the lower section 6 is provided with a reinforcement 23 which consists of an angular rail 24 conforming to the shape of the upper surface 25 of the upper edge 22 of the section 6 and also of a cantilever angle 26. The leg 27 of the angular rail 24 is connected with a parallel leg 29 of the cantilever angle 26 by, for example, four screw bolts 28. The leg 30 of the angular rail 24 lies on the inside of the upper edge 22 of the lower section 6 and points downward. The leg 30 is fastened to the upper edge 22 of the lower section 6 by a number of screw bolts 31.

As is also apparent from FIG. 3, in which for the purpose of improving the clarity of this radial area only the reinforcement 23 is illustrated, the other leg of the cantilever angle 26 has secured thereto two guide casings 32 which surround the guide bolts 21 with the interposition of bushings 33 having good sliding properties, for example being made of polyethylene. As becomes apparent, the upper edge 22 of the lower section 6 with the reinforcement 23 attached thereto, is supported for vertical but against lateral movement on the guide bolts 21. Thus, whenever the edge of the carrying mechanism 3, illustrated in FIG. 2, is lifted or lowered corresponding to vibration deflections of the antenna mast 2, then the guide casing 32 may slide vertically along the guide bolts 21 and no noticeable tensional or buckling forces are introduced into the wall of the section 6 from its upper edge 22.

The angular rail 16 at the lower edge of the upper section 6 lies generally parallel to the angular rail 24 with its horizontal leg 34 beneath the lower surface 35 of the upper section 6, and its vertical leg 36 at the inside of the section 6. As is apparent especially from FIG. 3 with regard to the angular rail 24, the angular rails 16 and 24 extend circumferentially throughout at least a large part of the periphery of the lower edge 15 and of the upper edge 22 of the adjacent sections 6, whereas the carrying plate 14 and the cantilever angle 26 extend circumferentially only about the width of the steel fishplate 12. Like the angular rail 24 at the upper edge 22, the angular rail 16 at the lower edge 15 is attached thereto by screw bolts 37 which essentially horizontally penetrate the wall of section 6 that is made of hard foam, especially polyurethane hard foam, and clamp the lower edge 15 against the leg 36 of the angular rail 16. The lower edge 15 of the upper section 6 is fixed rigidly to the carrying mechanism 3 by a connection between the angular rail 16 and the carrying plate 14 by way of screw bolts 38 similar to the screw bolts 28.

In order to permit relative movement between the reinforcement 23 and the guide bolts 21 or the carrying mechanism 3, an extension or expansion joint 39 with a sufficiently large gap between the reinforcement 23 and the carrying plate 14 is provided at the opposed surfaces 25 and 35 of adjacent sections 6. In the expansion joint 39, an annular soft seal 40 is disposed which, for improvement of the clarity in FIG. 2, has merely been indicated by dash dot outside contours. The soft seal 40 consists, for example of close-celled neoprene foam or some other raw material, which, with a low counterpressure rise, has a compressibility of up to about 90% and therefore may be compressed without a considerable build-up of tension to one tenth of its height, so that the soft seal 40 may follow changes in the size of the gap of the expansion joint 39.

The lower edge 15 and the upper edge 22 of each section 6 are covered by framing profiles 41 and 42 which may consist of a wear resistant raw material, such as fiber reinforced, unsaturated polyester. The sides walls of the framing profiles 41 and 42 extend away from the end surfaces of the sections to a point beyond any kind of attaching or covering means.

The area of each expansion joint 39 is covered between adjacent sections 6 by an outer covering ribbon 43. The covering ribbon 43 extends circumferentially completely around the joint 39 with its upper edge effectively clamped to the lower edge 15 of the upper section 6 by the screw bolts 37. The lower edge of the ribbon extends over the heads of the screw bolts 31. In this manner, the lower edge of the covering ribbon 43 is movable with respect to the upper edge 22 of the lower section 6 and may slide along the corresponding framing profile 42. Naturally, the fastening of the covering ribbon 43 may be accomplished inversely and have its upper edge slide on the framing profile 41 for the lower edge 15 of the upper section 6. As illustrated in FIG. 2, the outer side wall of the lower framing profile 42 extends below the lower edge of the covering ribbon 43 the full distance of possible relative movements between adjacent sections 6, so that in all relative movements, a neat plane abutment of the lower edge of the covering ribbon 43 on an adjacent surface of the framing profile 43 will be guaranteed. For reasons of mounting techniques, the covering ribbon 43 is constructed similarly to the sections 6, i.e. from individual segments which have not been illustrated in detail, whereby the individual segments abut against each other with expansion joints that are displaced in relation to the expansion joints in the sections 6. Correspondingly, the framing profiles 41 and 42 may also be constructed from individual segments.

Figure 4:
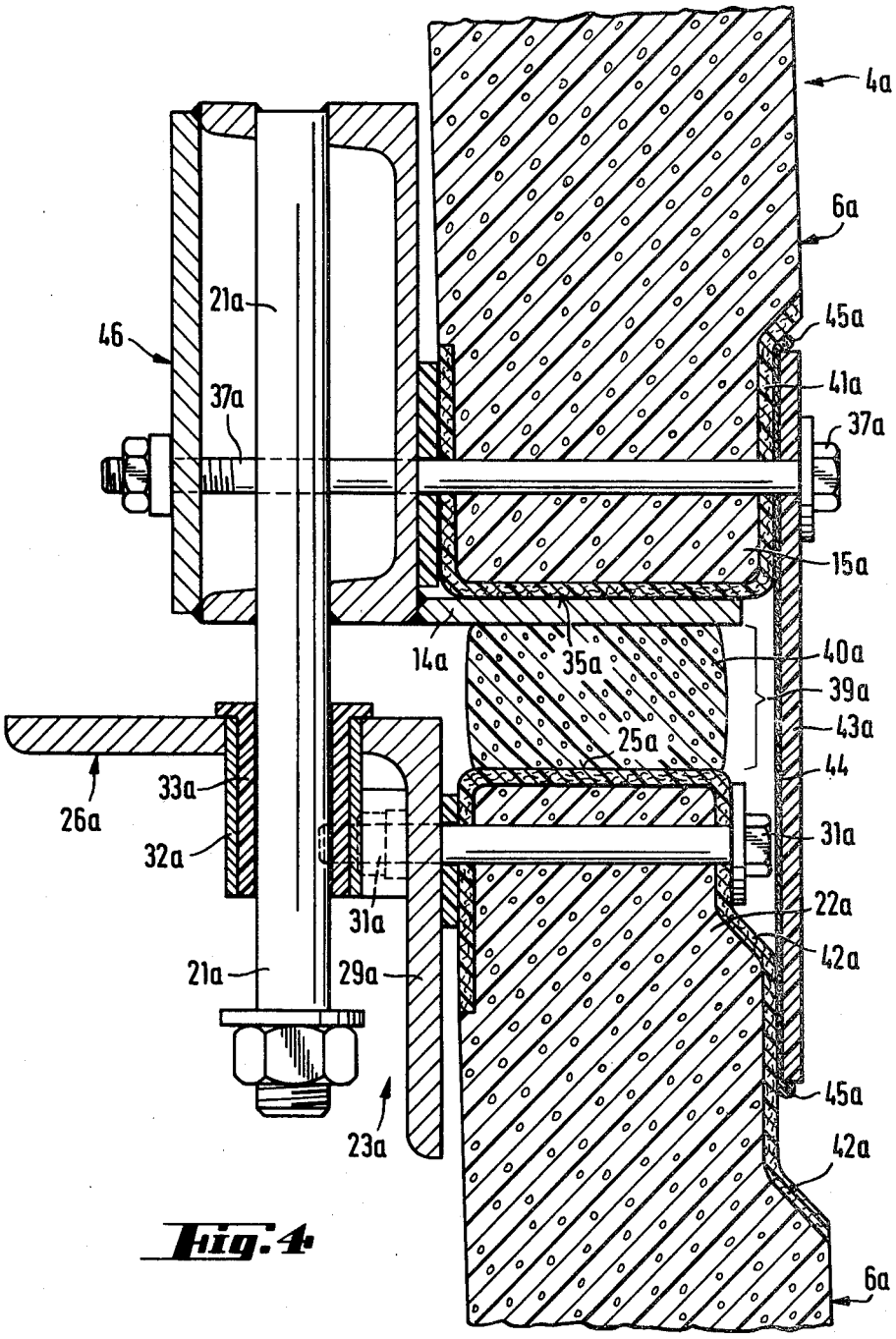
FIG. 4 is a modified embodiment of the detail according to FIG. 2.

FIG. 4 illustrates a modified embodiment in the area of the expansion joint between two sections. Construction elements corresponding functionally to the embodiment according to FIG. 2 are designated with the same reference numbers as in FIG. 2, however with the suffix "a", so that FIG. 4 is largely self-explanatory on the basis of the above explanation given to FIGS. 2 and 3. Differences exist. In the embodiment according to FIG. 4, the cylindrical outside walls of the framing profiles **41*a* and 42*a* for the lower edge 15*a* and the upper edge 22*a* of the adjacent sections 6*a* lie in a common plane, so that the covering ribbon 43*a* has a cylindrical shape. An additional sealing ribbon 44 is on the inside of the covering ribbon 43*a*, and overlaps the framing profiles 41*a* and 42*a* to provide additional sealing. The sealing ribbon 44 may consist, for example, of neoprene. An additional sealing of the gap area of the expansion joint 39 or 39*a* may be achieved in the case of both embodiments of FIGS. 2 and 4 by additional sealing ribbons or cords 45 and 45*a* at the edges of the covering ribbons 43 and 43*a*, so that even a gradual penetration of moisture may be safely avoided despite the considerable relative movement which occurs. An additional difference in the embodiment according to FIG. 4, as compared to that of FIG. 2, is that the plate 14*a* supporting the lower outer portion 35*a* of the lower edge 15*a* of the upper section 6*a* is attached to the lower area of a supporting construction designated generally at 46, which is penetrated by a screw bolt 37*a* for fixedly fastening the lower edge 15*a* so that the angular rail 16 in the embodiment of FIG. 2 is omitted. In the supporting construction 46 at least one guide bolt 21*a* is attached, preferably it is welded in, which projects below the carrying plate 14*a* and the supporting construction 46. The projecting portion forms the guide for a guide casing 32*a* provided with a plastic bushing 33*a* secured to a reinforcement 23*a* of the upper edge 22*a* of the lower section 6*a*. As compared to the embodiment of FIG. 2, the lower angular rail 24 is omitted because the horizontal leg of a cantilever angle 26*a* carries the guide casing 32*a* and the vertical leg 29*a* is attached directly to the upper edge 22*a* of the lower section 6*a* by the attaching bolt 31*a***. *The soft seal 40a* disposed in the gap of the expansion joint **39*a* therefore abuts directly on the upper surface 25*a* of the upper edge 22*a* of the lower section 6*a***.

The supporting construction 46 is attached to a platform 10 etc., in a manner not shown in detail, but is fixed against movement relative to the antenna mast 2, while the upper edge **22*a* of the lower section 6*a* is movable with its reinforcement 23*a* to reduce or enlarge the gap of the expansion joint 39*a* by the guide casing 32*a* sliding on the guide bolt 21*a***.

As the preceding description shows, multiple changes and modifications of the illustrated embodiments are possible without departing from the scope of the invention. Thus, for example, in a kinematic reversal, the guide casing 32 or **32*a* may be attached to the carrying mechanism 3 while a corresponding guide bolt 21 or 21*a* inversely is attached to the reinforcement 23 or 23*a*. Insofar as the hard foam material of the sections 6*a* may absorb tension loads similarly well as pressure loads, it would be possible beyond that to fix the upper edge 22 or 22*a* of each section 6 or 6*a* to the carrying mechanism 3 and to make the lower edge 15 or 15*a* movable. Also the expansion joint may be shifted into a central area between superposed supporting mechanisms 3, as will be explained subsequently in more detail in connection with FIG. 5. However, it is essential in any case, that no bilateral rigid fixation of the section 6 or 6*a* be made at the adjacent section or at the carrying mechanism 3 or 3*a*, so that the relative movements of the individual sections 6 or 6*a* as described, will be possible mutually and vis-a-vis the assigned carrying mechanism 3 in order to avoid a build-up of tension in the material of the section 6 or 6*a***.

Figure 5:
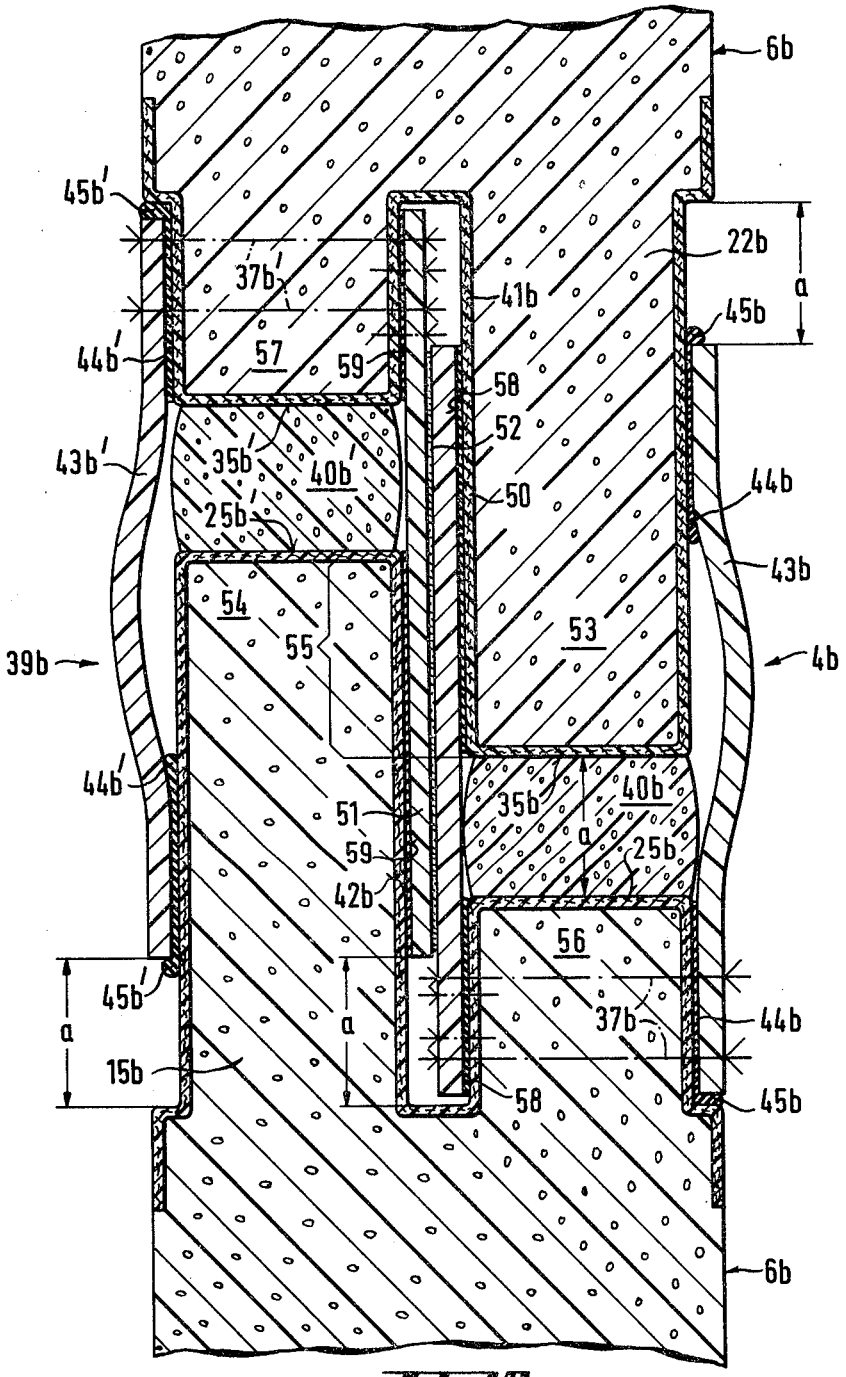
FIG. 5 is a sectional view of another embodiment of an expansion joint in a presentation essentially corresponding to FIG. 4.

In the embodiments according to FIGS. 1 to 4 one of the edges 15 or **15*a*, or 22 or 22*a* of the expansion joint 39 or 39*a* is fixed to a carrying mechanism 3, while the other edge is movable with a corresponding change in the width of the gap of the expansion joint 39 or 39*a*. However, the invention is basically applicable also to all cases where, as illustrated in FIG. 5, both edges 15*b* and 22*b* lie at a distance outboard of rigid supports and are movable vis-a-vis said supports in order to absorb thermal expansions, mechanical deformations by wind pressure, etc. For improvement of clarity, construction units corresponding to the FIGS. 2 and 4 have been given the same references in the embodiment according to FIG. 5, but with the suffix "b" so that the drawing will be understandable largely by itself and on the basis of the preceding explanations for the FIGS. 2 and 4**.

An expansion joint **39*b* illustrated in FIG. 5 with edges 15*b* and 22*b* supported on both sides not directly in the area of the gap, may be used both as a vertical joint as well as a horizontal joint. In use as a horizontal joint, one must however make sure that no load occurs in the area of the joint as a result of the weight of the part of the casing 4*b* above the joint or as a result of the section 6*b*. Said part therefore is supported by a carrying mechanism 3 even though possibly at a considerable distance from the expansion joint 39*b*. In use as a vertical joint, weight loads do not occur so that in the usual case no supporting loads have to be transmitted. The expansion joint 39*b* may be used as a vertical joint between sections 6 or 6*a* in the embodiments according to the FIGS. 2 and 4, possibly limited to the sections 6 or 6*a* in the lower area of a high tower-like casing 4 or 4*a*, where larger diameters of sections 6 or 6*a* occur and therefore heat tensions may reach higher values. As a vertical joint, the expansion joint 39*b* is however particularly suitable for cupola-shaped coverings of, say radar antennas, since as a result of a diameter of a few tenths of meters and as a result of the great sun-irradiated surface, heat tensions may occur to a particularly great extent which may be reduced by one or several expansion joints 39***b* which are guided along the contour lines containing the top of the cupola. The designation of a vertical joint is to be understood as meaning that movement of the edges 15*b* and 22*b* is accomplished without the expansion joint 39*b* having to lie altogether in the strict sense actually vertically. In fact, in the top area of cupolas an increasingly horizontal alignment of the longitudinal extent of the expansion joint 39*b* occurs but in this case, too, we are still always dealing with a vertical joint in the sense of this definition, since the relative movement of the edges 15*b* and 22*b* takes place unchanged.

As is clear from FIG. 5, the edges 15*b* and 22*b* of the expansion joint 39*b* have alternating projections 53 and 54 overlapping each other, which form a mutual abutting and supporting area in an overlapping area 55. Thus, forces directed transversely in relation to the expansion joint 39*b*, as shown in FIG. 5, may be absorbed by way of the two projections 53 and 54, and the edges 15*b* and 22*b* guide one another in the direction of movement. In this respect, a sliding surface 52 is provided between the projections 53 and 54 that is aligned in the direction of movement of the edges 15*b* and 22*b* and which is developed between two sliding bands 50 and 51 which cover up the adjacent abutting surfaces of the projections 53 and 54. The bands 50 and 51, just like the covering ribbons 43*b*', may be held on the outside and on the inside by suitable attaching bolts 37*b* or 37*b*' on corresponding fastening projections 56 and 57 of the edges 15*b* and 22*b*, whereby the heads of the attaching bolts are at least countersunk in the bands 50 and 51 and do not interfere with relative movement. In this way, there is provided a path for the relative movement of the edges 15*b* and 22*b* corresponding to the dimension a, as becomes easily understandable from the drawing. Soft seals 40*b* and 40*b*' between the projections 53 and 54 on the one hand and the projections 56 and 57 on the other hand, have at least a constructional height corresponding to the dimension a, so that in view of their large compressibility, a corresponding long path of movement is also available. The edges 15*b* and 22*b* likewise have corresponding framing profiles 41*b* and 42*b* by way of which the soft seals 40*b* and 40*b*' are supported on both sides on corresponding opposing surfaces 25*b* and 35*b*, and 25*b*' and 35*b*'. Between the framing profiles 41*b* and 42*b* and the opposed sides of the bands 50 and 52 in their area of attachment, a hard rubber gasket 58 or 59 may be inserted. The covering bands 43*b* and 43*b*' are sealed against the entry of moisture by corresponding sealing bands 44*b* and 44*b*' as well as by ribbon seals 45*b* and 45*b*', whereby one may refer to the corresponding embodiments of FIGS. 2 and 4 for the details of all these construction elements.

A suitable auxiliary means for sliding may be disposed in the area of the surface 52 between the bands 50 and 51, for example, a layer of graphite or a APTK-ribbon, the nylon material of which has good sliding properties, may be paired with the material of the gliding bands 50 and 51. Beside the attaching bolts 37*b* and 37*b*' as well as corresponding nuts, which however in case of need may be made of glass fiber reinforced plastic, there need to be no material whatever in the area of the expansion joint 39 which would cause a breakdown of electromagntic waves. Insofar as the permeability for electromagnetic waves, at least in certain sections over the length of the expansion joint 39*b*, plays no essential role in an individual case, steel bolts and steel nuts may be used for attaching bolts 37*b* and 37*b*', and the covering bands 43*b* and 43*b*', as well as the bands 50 and 51 may be developed from glass fiber reinforced plastic with a steel insert.

The alternate cover up of the edges 15*b* and 22*b* by projections 53 and 54 in the area of the expansion joint 39*b*, particularly in conjunction with the covering bands 43*b* and 43*b*' as well as the bands 50 and 51 with their rear side support on hard rubber gaskets 58 and 59, makes a very effective labyrinth seal. This may be of particular significance, especially in a location which places strong stress by sand or water on the casing 4*b*, in preventing assuredly any penetration of sand or water in the area of the expansion joint 39*b* in the event of sandstorms or rainstorms.

What is claimed is:

1. A tower or cupola-like covering for the protection of antennae for electro-magnetic radiation against the weather, the antennae being fastened to supporting structure within the covering and the latter being in the form of a sectioned casing of weather-resistant material permeable to electromagnetic waves, characterized in that each casing section is attached at a location remote from one of its edges rigidly to the supporting structure within the covering and with said one edge being movable relative to the adjacent edge of an adjacent section, and in that the sections have weather-excluding expansion joints therebetween which transmit no supporting forces.

2. Covering as in claim 1, characterized in that each expansion joint is bridged by at least one soft gasket.

3. Covering as in claim 1, characterized in that each expansion joint is covered up at least at its outside against penetration by weather by a covering ribbon.

4. Covering as in claim 1, characterized in that the adjacent edges of the sections are each covered up by a framing profile.

5. Covering as in claim 3, characterized in that the adjacent edges of the sections are each covered up by a framing profile and the the outside lateral wall of the framing profile on the top edge of each section extends below the slidably moveable, adjacent edge of the cover-up ribbon.

6. Covering as in claim 3, characterized in that one edge-parallel ribbon seal is provided at the opposite edges of each cover-up ribbon.

7. Covering as in claim 1, characterized in that both edges of each expansion joint are moveable in relation to the supporting structure.

8. Covering as in claim 7, characterized in that both edges have projections overlapping with a sliding surface therebetween.

9. Covering as in claim 8, characterized in that the sliding surface is developed between two slipbands attached to the respectively over-lapping opposed surfaces.

10. Covering as in claim 3, characterized in that the cover ribbon consists of a multiplicity of individual segment shaped cover plates which abut each other with beaded expansion joints.

11. Covering as in claim 10, characterized in that the expansion joints of the cover plates are displaced in relation to the expansion joints between individual sections of the casing.

12. Covering as in claim 11 including interengaging means on the one edge and on the supporting structure for restraining said one edge against lateral movement.

13. Covering as in claim 1 in which the one edge is one of the lower and upper edges of the casing section.

14. Covering as in claim 13, characterized in that there is a tower-like development of the casing with several coaxially superposed sections about an antenna mast comprising the supporting structure, said sections are supported by carrying mechanisms attached to the mast in several superposed planes, each section is attached rigidly to one of said carrying mechanisms and the one edge of each section is restrained to vertical relative movement by the expansion joint thereat.

15. Covering as in claim 14, characterized in that on the carrier mechanism supporting each section at least one vertical guide bolt is attached on which a reinforcement, attached to the upper edge of the adjacent section, is mounted slidably.

16. Covering as in claim 15, characterized in that the reinforcement has a guide casing which surrounds the guide bolt.

17. Covering as in claim 16, characterized in that the guide casing is lined with a plastic sleeve.

* * * * *